United States Patent [19]

Vanderklaauw

[11] 4,011,705

[45] Mar. 15, 1977

[54] METHOD FOR CONSTRUCTING A THIN-SHELL CONCRETE STRUCTURE DESIGNED FOR LIFTING WITH HYDRAULIC APPARATUS

[76] Inventor: Peter Martin Vanderklaauw, 1450 Madruga Ave., Coral Gables, Fla. 33146

[22] Filed: Oct. 31, 1975

[21] Appl. No.: 627,835

[52] U.S. Cl. ..... 52/745; 52/741; 52/126; 52/236.2; 264/32; 264/34

[51] Int. Cl.[2] ..... E04B 1/00; E04H 1/00

[58] Field of Search ..... 52/745, 236, 126, 83, 52/588, 741; 264/32, 34, 35

[56] References Cited

UNITED STATES PATENTS

| | | | |
|---|---|---|---|
| 2,413,243 | 12/1946 | Neff | 264/32 |
| 2,596,914 | 5/1952 | Piacentino | 264/34 |
| 3,086,753 | 4/1963 | Cushman | 52/126 |
| 3,092,216 | 6/1963 | Tye, Jr. | 52/745 |
| 3,239,990 | 3/1966 | Adler | 52/745 |
| 3,260,028 | 7/9166 | Fraser | 52/745 |
| 3,421,271 | 1/1969 | Whitfield | 52/126 |
| 3,485,000 | 12/1969 | Fiquet | 52/588 |
| 3,525,185 | 8/1970 | Bloxom | 52/745 |
| 3,594,965 | 7/1971 | Saether | 52/126 |
| 3,744,205 | 7/1973 | Moss | 52/741 |
| 3,791,093 | 2/1974 | Finsterwalder et al. | 52/745 |
| 3,801,685 | 4/1974 | Bell, Jr. | 264/32 |
| 3,929,944 | 12/1975 | Oliver | 264/34 |

*Primary Examiner*—Price C. Faw, Jr.
*Assistant Examiner*—Robert C. Farber
*Attorney, Agent, or Firm*—Harold L. Stowell

[57] ABSTRACT

A method for constructing a thin-shell concrete structure of round design comprising, pouring on soil of the main floor, applying reinforced concrete against a dome shaped liner of insulating material, and raising the resulting structure so as to allow a lower floor to be constructed.

8 Claims, 26 Drawing Figures

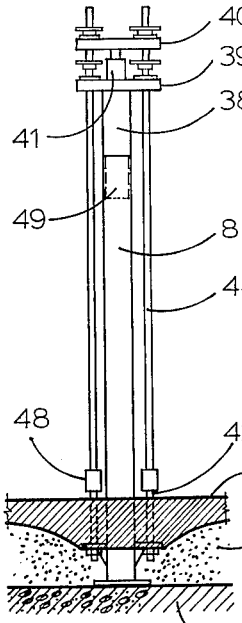
FIG. 17
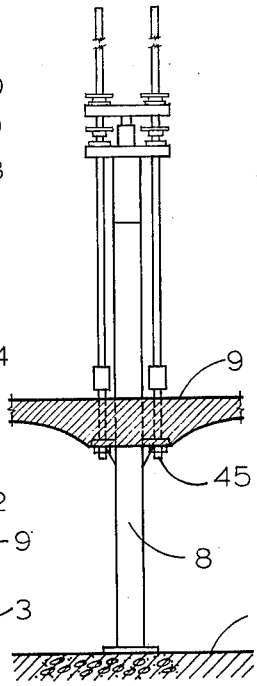
FIG. 18
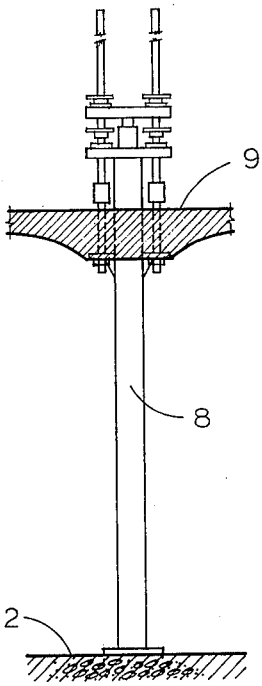
FIG. 19
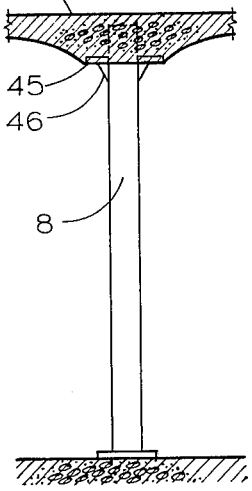
FIG. 20
FIG. 25
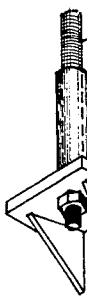
FIG. 26
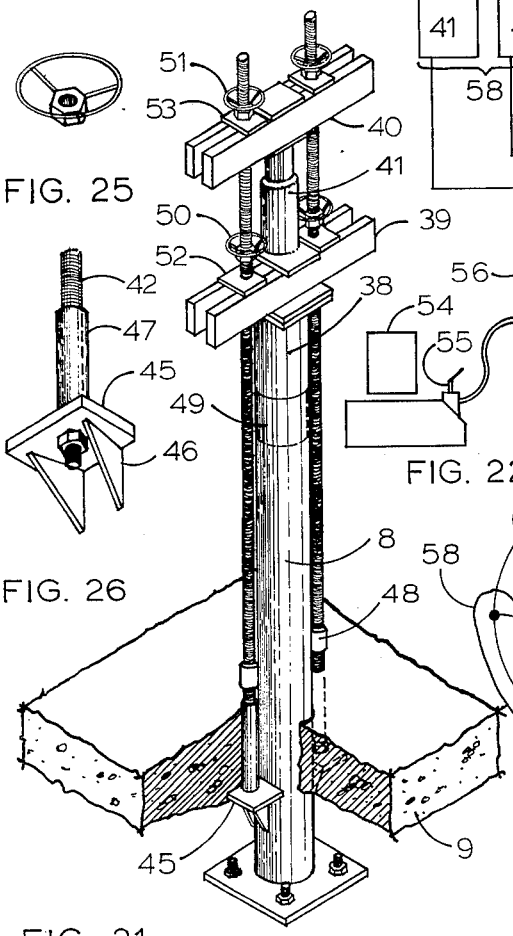
FIG. 21
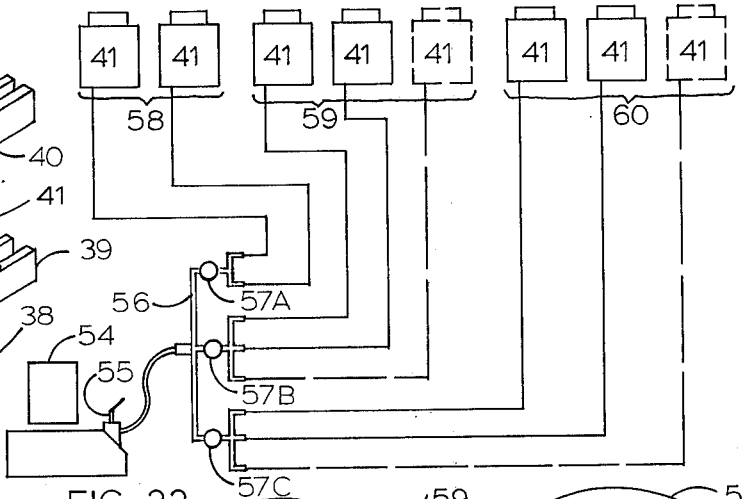
FIG. 22
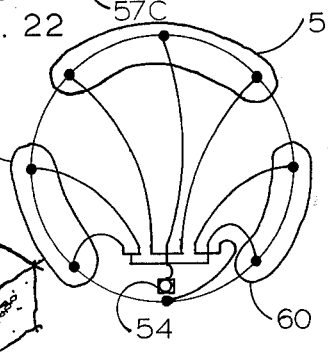
FIG. 23
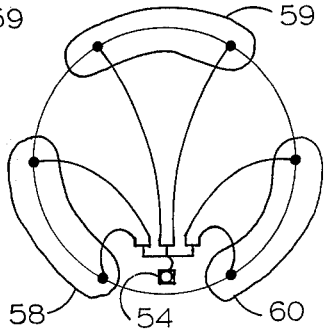
FIG. 24

METHOD FOR CONSTRUCTING A THIN-SHELL CONCRETE STRUCTURE DESIGNED FOR LIFTING WITH HYDRAULIC APPARATUS

This invention relates to the method of building a thin-shell concrete structure, the apparatus for carrying out the method, and the unique shape of the structure resulting from the method.

It is well known that bending or forming flat plates in compound curves or shells makes them strong and stable. The idea is used in aircraft, automobiles and boats, and permits shells to be thin.

Thin concrete shells have been used extensively in the construction industry, mostly in non-residential construction. Although construction of thin-shells is economical in the use of materials, concrete shells are generally expensive because much labor and materials is spent on forming.

The present invention has for its object to provide a method for building a concrete enclosure inexpensively such that the resulting enclosed space provides a comfortable, pleasant and safe habitat.

A feature of the invention is that practically no formwork is used, and the need for scaffolding and cranes is eliminated. This is accomplished by pouring the main floor, or suspended floor, on the ground which is shaped preparedly to receive the concrete. Subsequently a liner of insulating material is erected in the shape of a dome, and after steel reinforcement is placed over this linear, concrete is applied by means of a spray apparatus. Windows, doors and partitions are installed while the shell structure is at ground level.

In the next step the entire concrete enclosure is lifted a full story above the ground by means of a lifting system involving hydraulic jacks. A lower floor is then built in a conventional manner.

The shape of the shell enclosure is significant in three ways; one is that it makes good engineering sense having hoop steel encased at the roof edge, which is inherently strong and stable, allowing the thin shell to continue from the roof into the walls without a specially formed tension ring; the second is that the interior space created by the shape of the dome is dynamic and attractive for living space; and the third is that during construction every part of the wall can be reached from the ground, while the roof is shallow enough to walk on, thus facilitating concrete spray operation and finishing without the use of scaffolding.

The shell structure may be so designed that it remains permanently on the ground or the shell may be designed for lifting at a later date.

A further feature of the invention is the peculiar shape of the floor in which a ring-beam connecting to the columns forms an integral part of the floor. The resulting shape is easily screeded in sand or soil and is extremely stable, thereby combining practicability and good engineering logic. The integral ringbeam feature is equally useful in structures not designed for lifting.

A still further feature of the design is the manner in which the structure is lifted. The art of lifting with tension rods, crossheads, nuts and hydraulic jacks in a hand-over-hand manner is well known. In this invention the hydraulic jacks are not synchronized, instead the jacks are connected in three sets, and the structure is lifted in a manner that the sets of jacks are raised sequentially. Lifting apparatus thus is simple, safe and fast and requires no special skill to operate.

Specific objects and characteristics of the invention will be more readily understood from the following detailed description and accompanying drawings in which;

FIG. 17 is a sectional elevation of a typical column with lifting apparatus attached; floor at starting level.

FIG. 18 is a sectional elevation of a typical column with lifting apparatus attached; floor in process of being lifted.

FIG. 19 is a sectional elevation of a typical column with lifting apparatus attached; floor at final level.

FIG. 20 is a sectional elevation of a typical column with lifting apparatus removed and floor attached to the column.

FIG. 21 is an isometric view of a typical column with lifting apparatus attached.

FIG. 22 is a diagram of the hydraulic system.

FIG. 23 is a diagram of the hydraulic system connecting to eight columns.

FIG. 24 is a diagram of the hydraulic system connecting to six columns.

FIG. 25 is a detail of a nut with a wheel attached for hand tightening.

FIG. 26 is a detail of a bearing plate located below the concrete slab, and connecting to the tension rod.

Figure 1:
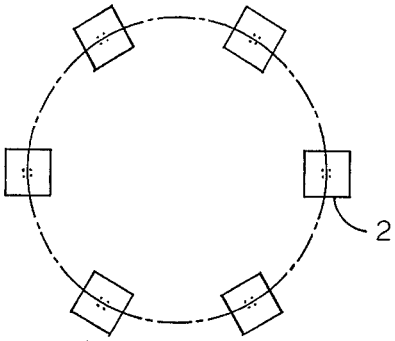
FIG. 1 is a plan of foundation pads or footings containing bolts for fastening steel columns.
Figure 2:
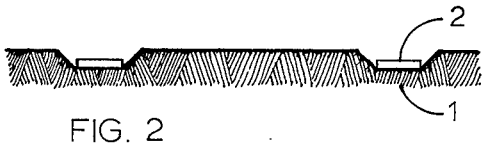
FIG. 2 is a section through foundation pads or footings placed in excavations.

Referring now to the illustrations and describing the construction method in more detail, the building process is started by pouring concrete foundation pads or footings 2 in excavation 1, as shown in FIGS. 1&2. Any other foundaton type including piles or raft may serve as a supporting base.

Figure 3:
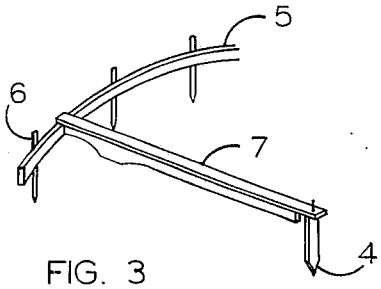
FIG. 3 is an isometric view of a screed supported by a pivot at one end and an edge form at the other end.
Figure 4:
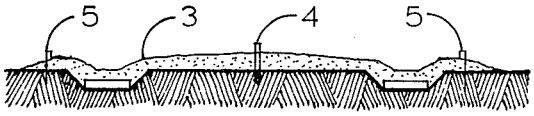
FIG. 4 is a section through foundation pads or footings and shows sand or soil screeded in a shape prepared to receive concrete.

Sand, gravel or soil, subsequently placed and spread, forms the base 3 for the concrete floor, FIG. 4. Using a pivot point 4 and an edge form 5 and stakes 6, a screed is revolved to shape the surface of the base, see FIG. 3. In a process of tamping, scraping and filling an accurately formed base is thus made. If the base 3 contains clay or other binder the surface can be compacted sufficiently making it suitable for pouring concrete directly on it. If the base 3 is loose sand or similar material it is advisable to use a slurry coat of sand and cement or other sealant spread thinly over the surface.

Figure 8:
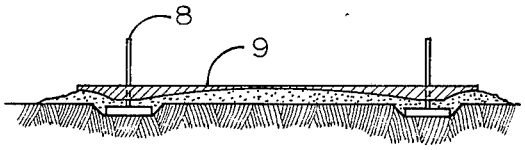
FIG. 8 is a section through the concrete floor poured in sand or soil prepared as in FIG. 4.

Before the concrete slab 9 is poured, as shown in FIG. 8, columns 8 are mounted on the foundation and reinforcing steel is placed.

Figure 5:
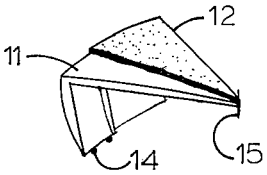
FIG. 5 is an isometric view of a revolving form consisting of an inner and an outer form and between which insulation material is applied by spray or frothing.
Figure 13:
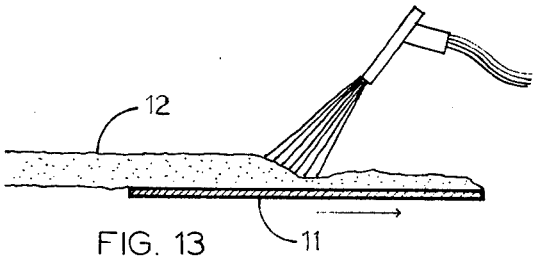
FIG. 13 is a detail of spray application of insulating material to a revolving form.

In the next step a liner in the shape of a dome 12,18,19 is made of insulating material. This can be done in a variety of ways. One is by using a revolving form 11 upon which insulation material 12 is sprayed to the required thickness, see FIGS. 5 & 13. The form 11 mounted on wheels 14 and supported by a pivot 15 is revolved and moved forward at the completion of each dome section thus creating a complete enclosure 12.

Figure 6:
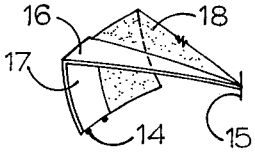
FIG. 6 is an isometric view of a revolving form consisting of an inner and an outer form and between which insulation materal is applied by spray or frothing.
Figure 7:
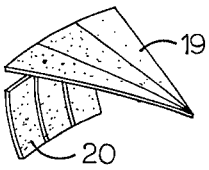
FIG. 7 is an isometric view of pre-cut insulation panels.
Figure 14:
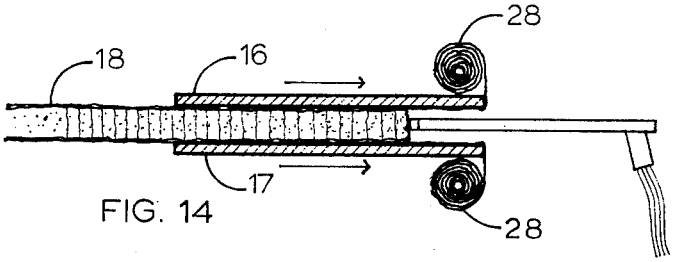
FIG. 14 is a detail of frothing or spray application of insulating material between two sides of a revolving form.

Another way to construct a liner is by using a double revolving form as shown in FIGS. 6 & 14. In order to assure that the insulating material 18 does not adhere to the inner form 17 or the outer form 16 paper rolls 28 are mounted at the mouth of the form. As the double form 16,17 moves forward the paper envelopes the insulating material thus allowing the form to revolve freely. Insulation material in this method may be applied by either spray or by frothing.

A third way to construct a liner is by using pre-fabricated or precut panels of insulating material 19,20. These panels may be pinned together with dowels or mounted with tape and adhesive or both.

Figure 9:
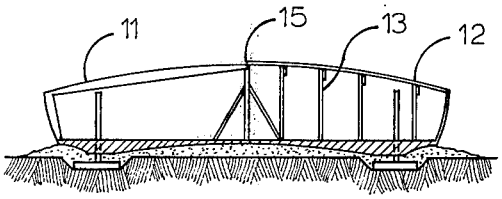
FIG. 9 is a section through the center of the shell structure showing a revolving form at left and an insulating liner supported by temporary shoring at right.

In all three methods it is necessary to provide temporary support 13 to prevent uplift and to support the concrete as shown in FIG. 9. This support system may be very light since the concrete is applied in layers and becomes self supporting as it hardens during the building process.

Figure 10:
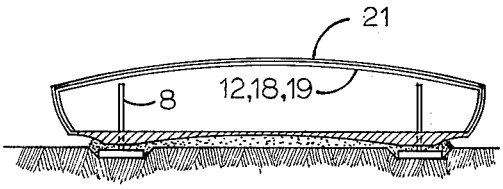
FIG. 10 is a section through the center of the shell structure showing concrete fused to the insulating liner, and shoring removed.

Concrete 21 may be applied using a wet system as through a plaster pump or a dry system as through gunite apparatus. The dry system is preferred as it provides a better bond with the insulation and is generally free from cracks, FIG. 10. This concrete is slowly built up in layer requiring good judgement of the nozzleman. The walls are made first, then the roof edge where the hoop steel 30 is encased, then the roof itself.

Figure 11:
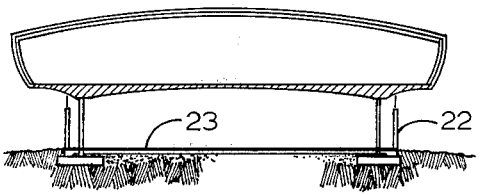
FIG. 11 is a section through the center of the shell structure complete after lifting and construction of a lower floor.

The entire structure is lifted after the concrete is cured, FIG. 11. Subsequently the lower floor is constructed 22, 23 using conventional methods. The shell structure may be left without lower floor.

Before lifting and before concrete is applied as in FIG. 9 windows 24 are mounted against the insulating liner. These windows have curved glass or plexiglass to restrict view in and enhance view out as with sunglasses. Flat windows may be used but are considered unsuitable from an architectural point of view. Window frames are fused into the concrete.

Figure 12:
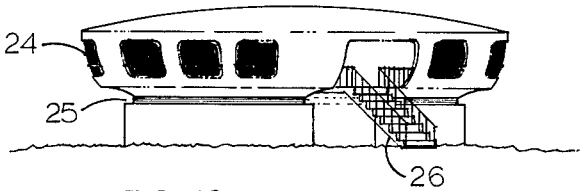
FIG. 12 is an elevation of the completed structure.
Figure 15:
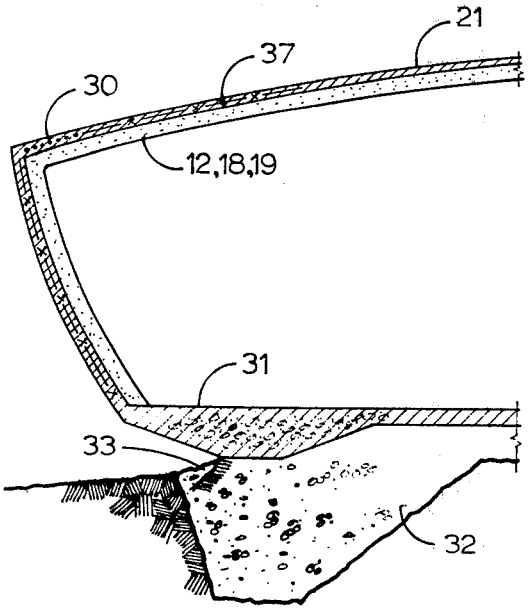
FIG. 15 is a partial section through a completed shell permanently located on the ground.

A glass or plexiglass strip 25, FIG. 12, permits light into the lower floor. Stairs 26 provide access to the upper floor through a covered entranceway. The shell structure may be left at ground level as shown in FIG. 15. In this case a nonfrost-susceptible material 32 needs to be used for foundation pad. The ringbeam 31 in this case is located toward the outside of the floor slab, FIGS. 15 & 16 clearly show a thickening of the roof shell at the edge containing the hoop steel 30. The roof requires little steel and comprises wire mesh 37, preferably galvanized to prevent rusting and staining.

Figure 16:
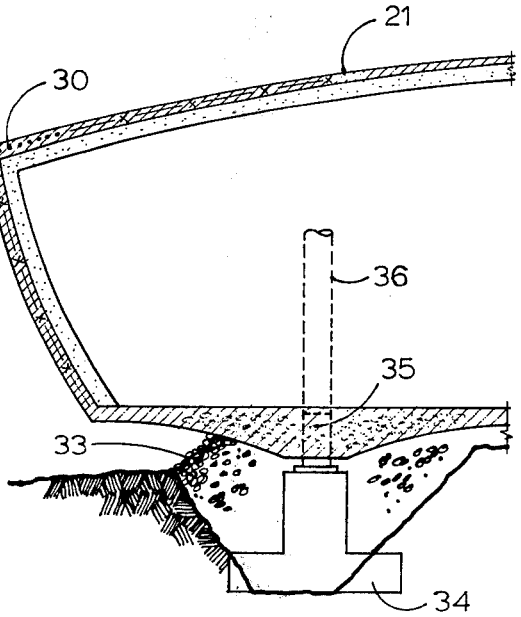
FIG. 16 is a partial section through a completed shell located on the ground and prepared for lifting at a later date.

The shell structure may be designed for lifting at a later date as shown in FIG. 16. In this case also a nonfrost-susceptible pad is provided. The pad is sealed at the edge with concrete overspray 33 to prevent runout. When lifting is decided upon a pipe column 36 is inserted in a previously placed column stub 35 connecting to a previously placed foundation 34. Lifting procedure thereafter is the same as the lifting procedure described hereafter. FIGS. 17,18,19 and 20 describe the lifting operation in more detail illustrating the procedure in steps.

At the pouring of the floor 9, bearing plates 45 are poured into the concrete. Attached to these bearing plates, FIG. 26, are two wing plates 46 and a vertical tube 47. The wing plates are used to weld the bearing plates 45 to the column when the floor is in final position as shown in FIG. 20. The tube 47 provides lateral space for a short threaded rod 42 having a nut at the bottom.

In preparing for lift-off a column extension 38 is placed on top of each column. This column extension has a narrow section 49 fitting inside the pipe column 8. A lower crosshead 39 is placed on top of the extension, then a hydraulic jack 41 and then an upper crosshead 40.

Subsequently threaded tension rods are suspended from the crossheads. These rods are connected to the short threaded rods 42, already in place, by means of a connector 48. The threaded rods have two nuts each, 50 and 51, and through slide plates 52, 53 these nuts bear upon the crossheads.

The lifting action is as follows: starting with all the nuts in lowered position the jack 41 is activated thus lifting the top crosshead and consequently lifting the tension rods and consequently lifting the floor slab. When the extended position on the jack is reached the lower nuts 50 are tightened. This allows the jacks 41 to be returned to their starting position. After the upper nuts 51 are then tightened a new cycle can begin. The nuts have hand wheels to facilitate turning by hand.

To assure that the lifting action does not induce undue stresses, the jacks are connected in a manner such that the structure floats on three oil bodies 58, 59 and 60 each individually valved. The three oil bodies each comprise a single oil manifold which is connected to the source of pressure fluid. The jacks are then connected to such manifolds in sets as illustrated in FIGS. 22, 23 and 24. Each oil body, or interconnected set of jacks 41 can be operated separately. The advantage of this three-oil-body system is that very little accuracy is required. One set of jacks 41 can be extended as much as three inches before any of the other sets is operated. At the end of each cycle the progress at each set of jacks 41 is measured with a carpenters tape to insure that the shell structure rises in a reasonably level position.

There is a critical moment, and that is at the start of each cycle. Oil pressure must be applied just enough to loosen the bottom nuts of each set of jacks. Only after all bottom nuts are then raised about ¼ inch the sequential lifting can start.

The three-oil-body system is suitable for any number of columns. FIG. 23 shows eight columns connected, FIG. 24 shows six columns connected.

Identifying the various parts in FIGS. 22 to 24, a hydraulic pump 54 provides the hydraulic pressure regulated by valve 55. The oil flows through manifold 56 and distributes to three circuits each individually controlled by valves 57A, 57B, 57C. Keeping valve 55 in open position each circuit is operated one after the other. Jacks are of the spring return type so that when the motor is turned off and all the valves are open all the jacks return to their original position.

What is claimed and desired to be secured by patent is:

1. A method of constructing a thin-shell concrete structure comprising the steps:

a. preparing foundation pads at spaced zones about the perimeter of the structure to be erected;

b forming a circular base for a concrete floor of sand, gravel or soil in the area bound by the foundation pads;

c. shaping the surface of the circular base by revolving a screed about a point at the center of the circular base;

d. placing vertical columns on each foundation pad;

e. placing reinforcing steel on the screed circular base;

f. pouring a concrete floor on the base including about the vertical columns;

g. forming an insulating liner having circular side walls and a dome-shaped top;

h. temporarily supporting the liner top from the concrete floor;

i. forming a concrete coating on the external surface of the side walls of the insulating liner;

j. forming a concrete coating on the external surface of the dome-shaped insulating liner; and k. removing the temporary supports for the liner top after the concrete is cured.

2. The method as defined in claim 1 wherein the insulating liner is produced by spraying or frothing an insulating material on a revolving form.

3. The method as defined in claim 1 wherein the insulating liner is produced by frothing or spraying an insulating material between a double-sided revolving form and a releasing agent is provided between the inner faces of the double-sided form.

4. The method as defined in claim 1 wherein the insulating liner comprises pre-cut assemblable panels.

5. The method defined in claim 1 including supporting a steel hoop about the upper end of the side walls of the structure prior to forming the concrete coating on the external surface of the domed-shaped insulating liner.

6. The method defined in claim 1 including installing a lifting mechanism about each of the vertical columns prior to pouring the concrete floor on the circular base.

7. The method defined in claim 1 including raising the cured concrete structure on each of the vertical columns one-story high.

8. The method defined in claim 7 wherein the lifting mechanism comprises a plurality of hydraulic jacks and the plurality of hydraulic jacks are interconnected into three groups.

* * * * *